US005927659A

United States Patent [19]

Yang

[11] Patent Number: 5,927,659

[45] **Date of Patent: *Jul. 27, 1999**

[54] IN-CORD DETACHABLE EAR HANGER FOR EARPHONE

[75] Inventor: Bill Yang, Taipei, Taiwan

[73] Assignee: Cotron Corporation, Taipei, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 08/774,742

[22] Filed: Jan. 3, 1997

[30] Foreign Application Priority Data

Dec. 9, 1996 [TW] Taiwan ..... 85219049

[51] Int. Cl.[6] ..... H04R 25/02

[52] U.S. Cl. ..... 248/58; 248/51; 248/339; 248/316.2; 381/381; 181/129

[58] Field of Search ..... 381/68.6, 68.7, 381/69, 183, 187, 188, 205, 330, 381; 181/129, 135, 130; 248/65, 51, 49, 58, 60, 316.2, 214, 339; 63/12, 14.1, 14.8, DIG. 3

[56] References Cited

U.S. PATENT DOCUMENTS

| | | | |
|---|---|---|---|
| 240,866 | 5/1881 | Travers | 24/129 R |
| 447,618 | 3/1891 | Miller | 24/129 R |
| 823,820 | 6/1906 | Steinberger | 248/49 X |
| 1,346,777 | 7/1920 | White . | |
| 1,397,051 | 11/1921 | Hopkins | 24/129 R |
| 2,545,731 | 3/1951 | French | 181/135 |
| 2,573,132 | 10/1951 | French | 181/135 |
| 2,611,831 | 6/1952 | Cates | 381/205 |
| 2,802,249 | 8/1957 | Kulp | 248/51 X |
| 3,513,269 | 5/1970 | Wilson | 381/68.6 |
| 3,851,123 | 11/1974 | Lipinski et al. | 181/135 X |
| 3,999,177 | 12/1976 | Greene | 381/68.7 X |
| 4,893,344 | 1/1990 | Tragardh et al. | 381/187 |
| 4,993,065 | 2/1991 | Chiou . | |
| 5,298,692 | 3/1994 | Ikeda et al. . | |

FOREIGN PATENT DOCUMENTS

| | | |
|---|---|---|
| 221 949 | 9/1924 | United Kingdom . |

*Primary Examiner*—Ramon O. Ramirez
*Assistant Examiner*—Stephen S. Wentsler
*Attorney, Agent, or Firm*—Pillsbury Madison & Sutro LLP

[57] ABSTRACT

An in-cord detachable ear hanger for an in-ear phone is provided. The ear hanger can protect the in-ear phone from being pulled off position from the user's ear when the user or any nearby person accidentally pulls the cable connected to the earphone set in a jerked manner. The ear hanger includes a shank body, a substantially hook-like portion, and a cable grasping means in substantially anchor-like shape. The hook-like portion is shaped in such a manner as to snugly fit to the back of a user's ear. The cable grasping means can grasp a selected portion of the cable, by which a margin length of the cable is left between the ear hanger and the speaker element inserted in the user's ear. During use of the in-ear phone, when any part of the cable other than the margin length is pulled in a jerked manner, the ear hanger would be pulled off the ear, but in most of the cases the speaker element would still stay in position in the user's ear.

3 Claims, 3 Drawing Sheets

IN-CORD DETACHABLE EAR HANGER FOR EARPHONE

BACKGROUND OF THE INVENTION

1. Field of the Invention

This invention relates to an in-cord detachable ear hanger for in-ear phone, and more particularly, to an in-cord detachable ear hanger for an in-ear phone which can keep the in-ear phone from being drawn away from the ear when the user or anybody accidentally pulls the cable connected to the earphone set.

2. Description of Related Art

In-ear phone is widely used in conjunction with an audio means, such as a portable radio, a stereo cassette player, an audio CD (compact disc) player, a pager, or a mobile phone, to serve as a small sound receiving means which can be plugged into the ear for the user to hear the sound from the associated audio means. An in-ear phone is composed of at least one speaker element (a pair of speaker elements usually) that can be fitted into the user's ears and a pair of cables connecting the speaker elements to the associated audio equipment.

During use of the in-ear phone, the somewhat long and stretched cables connecting the speaker elements to the associated audio means can be pulled accidentally by the user or nearby person, thereby drawing the speaker elements out of the user's ears. This will not only cause interrupt to the reception of sound. The forceful jerking of the speaker elements from the user's ears could also cause injury to the user's ears and also cause damage to the connection of the earphone set.

SUMMARY OF THE INVENTION

It is therefore a primary objective of the present invention to provide an in-cord detachable ear hanger for an in-ear phone which can protect the in-ear phone from being pulled off position from the user's ear when the user or any nearby person accidentally pulls the cable connected to the earphone set. The the invention provides more comfort to a person using the in-ear phone and increases the life of the in-ear phone.

In accordance with the foregoing and other objectives of the present invention, an in-cord detachable ear hanger for an in-ear phone is provided. The in-cord detachable ear hanger includes a shank body having a first end and a second end. A substantially hook-like portion is formed on the first end of the shank body and shaped in such a manner as to snugly fit to the back of a user's ear. Further, a cable grasping means is formed on the second end of the shank body for grasping a selected portion of the cable, by which a margin length of the cable is left between the cable grasping means and the speaker element of the earphone.

In preferred embodiment, the cable grasping means is a substantially anchor-like portion formed on the second end of the shank portion. The anchor-like portion has a pair of arms substantially arranged in symmetry about the shank portion, which allows the cable to be wound through the intervals between the shank portion and the two arms in an interlaced manner such that the cable can be grasped by the anchor-like portion of the ear hanger. The hook-like portion on the first end of the shank portion is hung over the user's earlap.

During use of the in-ear phone, if the user accidentally pulls any sections of the cable except the margin length left between the speaker element of the earphone and the anchor-like portion, the ear hanger would be pulled off the ear. But since a margin length of the cable was left between the speaker element of the earphone and the ear hanger, the speaker element of the earphone could be in most of the cases not affected by the pulling of the cable and thus still stay in position in the user's ear.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENT

Figure 1:
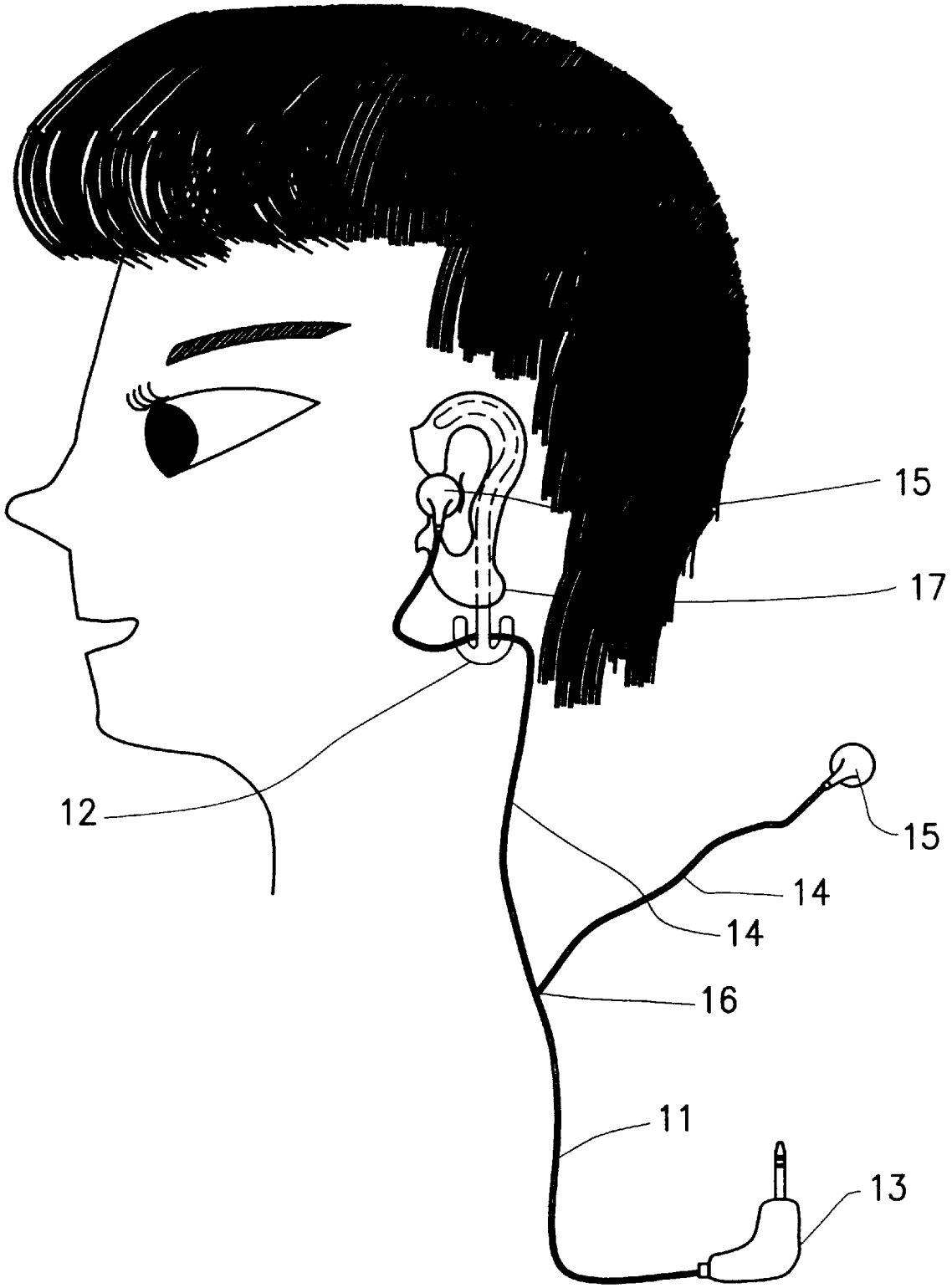
FIG. 1 is a schematic diagram depicting a user wearing an in-ear phone in conjunction with an ear hanger according to the present invention.

FIG. 1 is a schematic diagram showing a user wearing an in-ear phone 11 which is used in conjunction with a ear hanger 12 of the invention. The ear hanger 12 can protect the in-ear phone 11 from being pulled off position from the user's ear when the user or any nearby person accidentally pulls the cable 14 connected to the earphone set.

The in-ear phone 11 is of a conventional type, which includes a pair of speaker elements 15 that can be fitted into the user's ears. The speaker elements 15 are connected with the cable 14 to a plug 13 for connection to an audio means, such as a compact audio CD player (not shown). The cable 14 includes a number of wires which are bifurcated at the point 16 so that electrical sound signals from plug 13 from the audio means (not shown) can be conducted to both of the speaker elements 15. The branch portion of the cable 14 between the speaker element 15 to the bifurcated point 16 is mounted to the ear hanger 12 so that a margin length of the cable 14 is left between the ear hanger 12 and the speaker element 15. The ear hanger 12 is hung over user's earlap.

Figure 2:
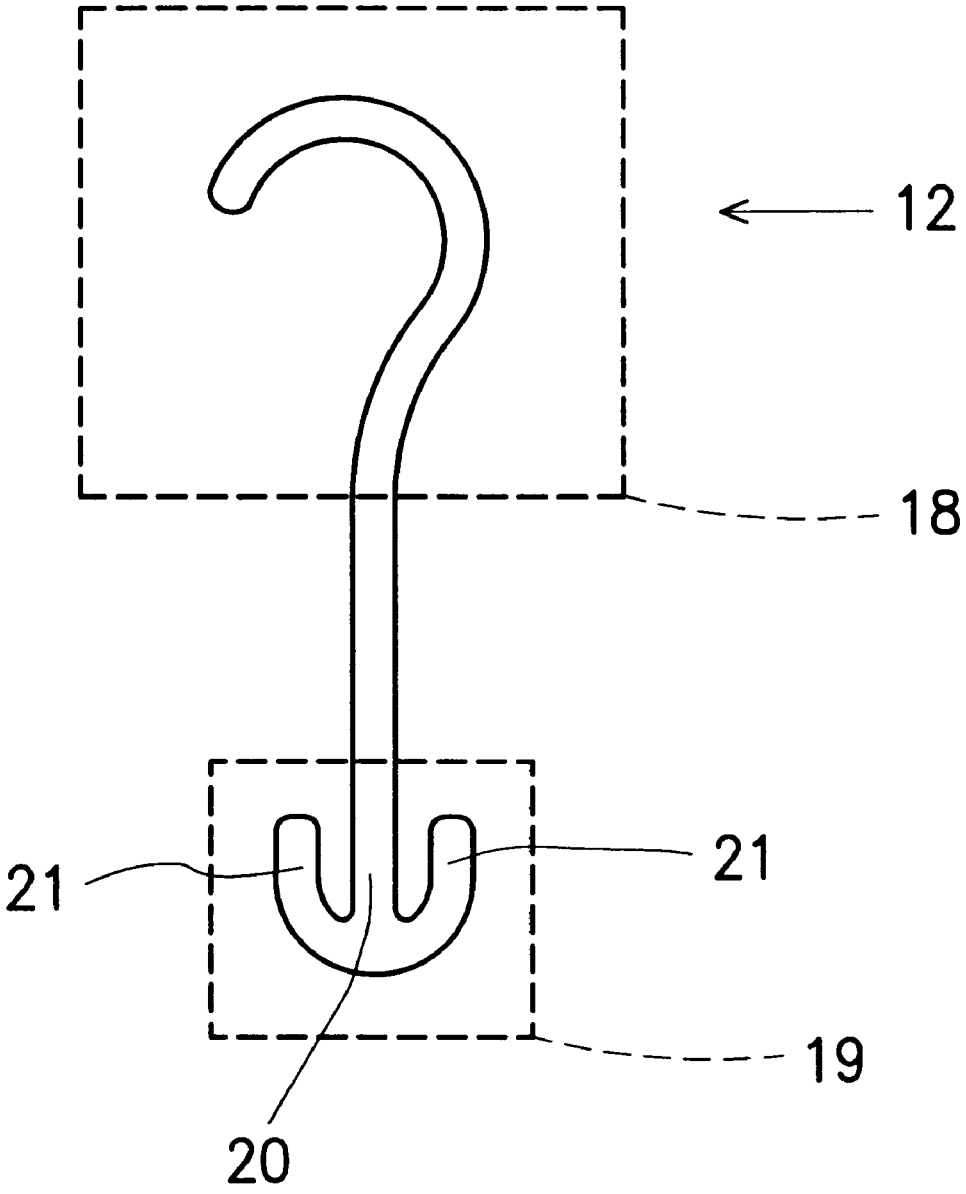
FIG. 2 is a schematic diagram of the ear hanger according to the present invention.

Referring to FIG. 2, the ear hanger 12 of the invention is an integrally formed piece formed with a substantially hook-like portion 18 on the upper end (first end) and a cable grasping means 19 on the bottom end which is in substantially anchor-like shape. The hook-like portion 18 of the ear hanger 12 is made of a soft, flexible, and comfortable material. The hook-like portion 18 is shaped in such a manner as to be snugly attached to the back of the user's earlap 17 so that the ear hanger 12 can be comfortably hung on the same, as illustrated in FIG. 1. The end of the hook-like portion 18 is elongated so as to form a shank portion 20. A preferred structure of the cable grasping means 19 is in a anchor -like shape including a pair of arms 21 substantially symmetric and parallel to the shank portion 20. In use, as shown in FIG. 1, the hook-like portion 18 of the ear hanger 12 is attached to the back of the user's ear and the cable 14 is wound through the intervals between the shank portion 20 and the two arms 21 in an interlaced manner such that the cable 14 can be grasped firmly by the cable grasping means 19 of the ear hanger 12.

Figure 3:
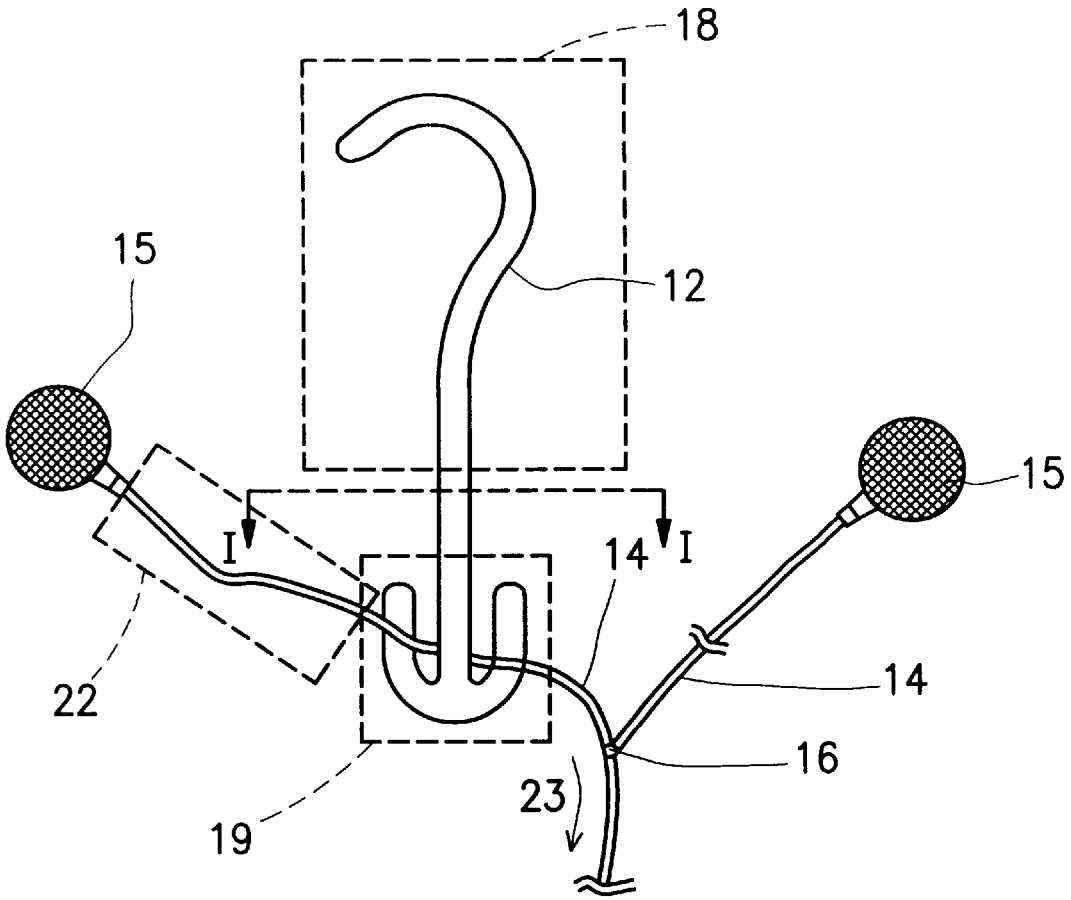
FIG. 3 is a schematic diagram used to depict the functionality of the ear hanger according to the present invention.
Figure 4:
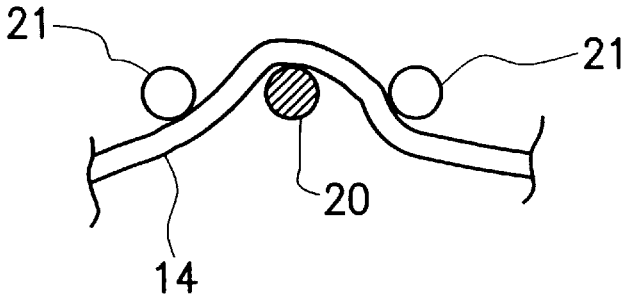
FIG. 4 is a cross sectional diagram of a cross-section I—I of the cable grasping means shown in FIG. 3 when used to grasp a portion of a cable.

Referring to FIG. 3 through FIG. 4, FIG. 3 is a schematic diagram used to depict the functionality of the ear hanger 12 of the invention, and FIG. 4 shows a cross-section view of the cable grasping means 19 shown in FIG. 3 cutting through the line I—I. In use, the cable 14 connecting the speaker element 15 to the bifurcated point 16 is wound through the intervals between the shank portion 20 and the two arms 21 in an interlaced manner as illustrated in FIG. 4, such that the cable 14 can be grasped firmly by the anchor-like cable grasping means 19 of the ear hanger 12. By doing this, a margin length of the cable 14, as designated by the reference numeral 22 in FIG. 3, is left between the speaker element 15 and the cable grasping means 19 of the ear hanger 12.

During use of the in-ear phone, if the user accidentally pulls any part of the cable 14 except the margin length 22, as the pulling force 23 shown in FIG. 3, the ear hanger 12 would be pulled off the ear. But thanks to the provision of the margin length 22 of the cable 14 between the speaker element 15 and the ear hanger 12, the speaker element 15 could be in most of the cases, should the margin length 22 be long enough, not affected by the pulling of the cable 14 and thus still stay in position in the user's ear.

The anchor-like portion of the ear hanger 12 acts as a grasping means 19 which can grasp a selected portion of the cable 14 to provide a suitable margin length between the speaker element 15 and the ear hanger 12 for protection of the speaker element 15 from being pulled off position from the user's ear when other part of the cable 14 is pulled in a jerked manner.

The ear hanger can protect the in-ear phone from being pulled off position from the user's ear when the user or any nearby person accidentally pulls the cable connected to the earphone. The hearing of the sound from the in-ear phone will thus not be interrupted. Further, this also protects the connecting portions of the speaker elements from being pulled loose to cause damage to the electrical connection between the speaker element and the cable. The in-ear phone is thus reliable in use with increased life of use.

The invention has been described using exemplary preferred embodiments. However, it is to be understood that the scope of the invention is not limited to the disclosed embodiments. To the contrary, it is intended to cover various modifications and similar arrangements. The scope of the claims, therefore, should be accorded the broadest interpretation so as to encompass all such modifications and similar arrangements.

What is claimed is:

1. An earphone apparatus, comprising:

an in-earphone, said in-ear phone comprising:
at least one speaker elements; and
at least one cable connected to the speaker element; and an in-cord detachable ear hanger, said in-cord detachable ear hanger comprising:
a shank body extending along a longitudinal axis having a first end and a second end;
a substantially hook-shaped portion connected to the first end of said shank body, said hook-shaped portion being shaped in such a manner as to snugly fit to the back of a user's earlap; and
a cable grasping member, connected to the second end of said shank body, said cable grasping member having an anchor-like shape, said cable grasping member defining a shank portion extending along said longitudinal axis and a pair of arms extending from the shank portion and arranged in symmetry about the shank portion, said symmetrically arranged arms lying substantially in the same plane as said shank portion, and said cable grasping member grasping said at least one cable.

2. The earphone apparatus of claim 1, wherein said substantially hook-shaped portion includes a soft and flexible material.

3. The earphone apparatus of claim 1, wherein said at least one cable being interlaced around said arms and said shank portion leaving a margin length of said at least one cable between said cable grasping member and said speaker element, and said arms and said shank portion arranged so as to provide a pressing force to said at least one cable interlaced around said arms and said shank portion to firmly grasp and restrict the movement of said at least one cable.

* * * * *